US007083049B2

(12) United States Patent
Schabel

(10) Patent No.: US 7,083,049 B2
(45) Date of Patent: Aug. 1, 2006

(54) METHOD OF REGULATING SORTING SYSTEMS AND A SORTING SYSTEM SUITABLE FOR CARRYING OUT THIS METHOD

(75) Inventor: Samuel Schabel, Darmstadt (DE)

(73) Assignee: Voith Paper Patent GmbH (DE)

( * ) Notice: Subject to any disclaimer, the term of this patent is extended or adjusted under 35 U.S.C. 154(b) by 0 days.

(21) Appl. No.: 10/308,439

(22) Filed: Dec. 3, 2002

(65) Prior Publication Data

US 2003/0116661 A1 Jun. 26, 2003

(30) Foreign Application Priority Data

Dec. 10, 2001 (DE) ..... 101 60 603

(51) Int. Cl.
*D21B 1/00* (2006.01)

(52) U.S. Cl. ..... 209/17; 209/552; 162/28; 162/55

(58) Field of Classification Search ..... 209/17, 209/552, 634, 680; 162/27, 28, 49, 55, 61, 162/254
See application file for complete search history.

(56) References Cited

U.S. PATENT DOCUMENTS 3,110,172 A * 11/1963 Irwin ..... 73/54.01

(Continued)

FOREIGN PATENT DOCUMENTS

DE 198 19 110 A1 11/1999

(Continued)

OTHER PUBLICATIONS

German Examination Report dated Oct. 16, 2002, in German with English translation cover page Applicant: Voith Paper Patent GmbH.
German Publication 1990 Wochenblatt Fur Papierfabrikation pp. 1031-1039 "Neue Wege zur Prozebfuhrung und Automatisierung in einer Altpaper-Aufbereitungsanlage" by J. Gutzeit.
PCT International Publication No. WO 01/59206 A1 dated Aug. 16, 2001 Applicant: Metso Paper Inc. for: Method of Controlling Quality of Pulp.

(Continued)

*Primary Examiner*—Joseph Rodriguez
(74) *Attorney, Agent, or Firm*—Hunton & Williams; Eugene C. Rzucidlo

(57) ABSTRACT

A method of regulating sorting systems, in particular multistage sorting systems, in paper production and a sorting system working in accordance with the method are described, in which the fiber suspension supplied in each case to a sorting stage is separated into at least one fine fraction and one coarse fraction and at least one portion of a coarse fraction is sorted again and at least the fine fraction thereby obtained is returned to the sorting process, with the mass flows at the input side and the output side being detected at each sorting stage of the sorting system by online measurement and/or by calculation and the values obtained being supplied to a processor associated with the sorting system for mathematical modeling and state regulation of the sorting system and with the mass flows at the output side and/or selectable machine parameters of the sorting system being influenced in dependence on pre-settable target parameters such as production, efficiency, fiber loss and the like.

13 Claims, 3 Drawing Sheets

U.S. PATENT DOCUMENTS

| | | | | |
|---|---|---|---|---|
| 3,873,416 | A * | 3/1975 | Forgacs et al. | 162/49 |
| 3,886,035 | A * | 5/1975 | Laakso | 162/55 |
| 4,342,618 | A * | 8/1982 | Karnis et al. | 162/49 |
| 6,080,274 | A * | 6/2000 | Hautala et al. | 162/55 |
| 2003/0041984 | A1* | 3/2003 | Jussila et al. | 162/28 |
| 2004/0031577 | A1* | 2/2004 | Ammala et al. | 162/49 |

FOREIGN PATENT DOCUMENTS

| | | | |
|---|---|---|---|
| DE | 19910910 | A1 | 9/2000 |
| DE | 19806732 | | 8/2001 |
| EP | 1035253 | | 7/1999 |
| GB | 2130759 | A * | 6/1984 |
| WO | WO 83/01969 | | 6/1983 |
| WO | WO 93/25752 | | 12/1993 |
| WO | WO 01/59206 | A1 * | 8/2001 |

OTHER PUBLICATIONS

European Search Report dated Apr. 25, 2003, for Pat. App. 02 024 605.4.

English translation of European Search Report dated Apr. 25, 2003, App 02 024 605.4.

* cited by examiner

METHOD OF REGULATING SORTING SYSTEMS AND A SORTING SYSTEM SUITABLE FOR CARRYING OUT THIS METHOD

FIELD OF THE INVENTION

The invention relates to a method of regulating sorting systems, in particular multi-stage sorting systems, in paper production in accordance with the preamble of claim 1 and to a sorting system suitable for carrying out this method.

BACKGROUND OF THE INVENTION

Sorting systems for paper production serve to separate a fiber suspension into at least two fractions, namely into a so-called fine fraction and a so-called coarse fraction, with the fine fraction consisting in large part of the water contained in the fiber suspension and of as many paper fibers as possible, while the coarse fraction, i.e. the fraction which cannot pass through the screens used in the respective sorters of the sorting system, should contain as few fibers as possible and, where possible, all disturbing impurities.

Since the disturbing impurities to be removed have a wide size spectrum, it is unavoidable for the impurities formed by smaller and very small particles to enter into the fine fraction together with the fibers. To minimize the portion of impurities in the fine fraction and to prevent as much as possible that disturbing substances are present at all in the fine fraction obtained at the output of a sorting plant, complex and/or expensive sorting methods have been developed which require plants with a larger number of sorters which can be connected in series and/or in parallel. However, it has been found that the success of a sorting plant is not only determined by the number of sorting units used and by their quality, but also and above all by the technical process design of the sorting method itself.

With every high quality sorting method, the largest possible purity of the fine fraction obtained at the end, the lowest possible fiber loss, i.e. minimum fiber portions in the coarse fraction, and the largest possible production volume are aimed for, with production or production volume being understood as the obtained accepted stock.

A particular problem area in connection with the obtaining of this objective results above all from fluctuations in the raw material quality which can be caused, in a negative sense, by larger amounts of advertising flyers inserted into newspapers and, in a positive sense, by falling raw material prices, which promotes the processing of materials which result in an above-average raw material quality. Such states of affairs make it difficult to control or regulate sorting systems of a known kind such that a specific target parameter—such as efficiency or minimum fiber loss—is achieved.

BRIEF DESCRIPTION OF THE INVENTION

It is the object of the invention to optimize a method of the kind recited in the preamble of claim 1 such that the aforesaid goals of a good sorting method can be achieved in the best possible manner, on the one hand, and target parameters which can be pre-set in the regulation carried out—such as efficiency and fiber loss—can be preset and fluctuations in the raw material quality can thereby be taken into account.

This object is satisfied by the features recited in claim 1.

In this connection, it is important for the invention that a complete balancing of the mass flows in all sorters is carried out via online measurements and/or calculations and that use is made thereof, and that the dependencies of the target parameters—such as efficiency and fiber loss—on the operating parameters are known and can be described by equations. The sorting system can, for this reason, be modeled by a linear equation system, with this model then being used in accordance with the invention by implementing a state regulator to run the plant in the optimum operating state.

Pre-settings can also be made by the operators via the state regulator, for example, also with respect to the target parameters "efficiency" and "fiber loss", in addition to the target parameter "production", by the regulation concept, which is ranked above the sorting system in this manner. These pre-settings are then transformed into regulated variables for the regulating valves by the regulation realized in accordance with the invention such that the sorting system runs ideally in accordance with the pre-settings.

It is of particular advantage in this connection that not only the regulating valves can be influenced via the state regulators, but that, for, example if a minimum fiber loss is aimed at, machine parameters can also be influenced such as, for example, the rotor speed of a sorter via a frequency converter.

BRIEF DESCRIPTION OF THE DRAWINGS

Further particularly advantageous embodiments of the method in accordance with the invention and a sorting system suitable to carry out the method in accordance with the invention are described in the dependent claims and will be explained with reference to an embodiment and to the drawing, in which are shown:

DETAILED DESCRIPTION OF THE INVENTION

Figure 1:
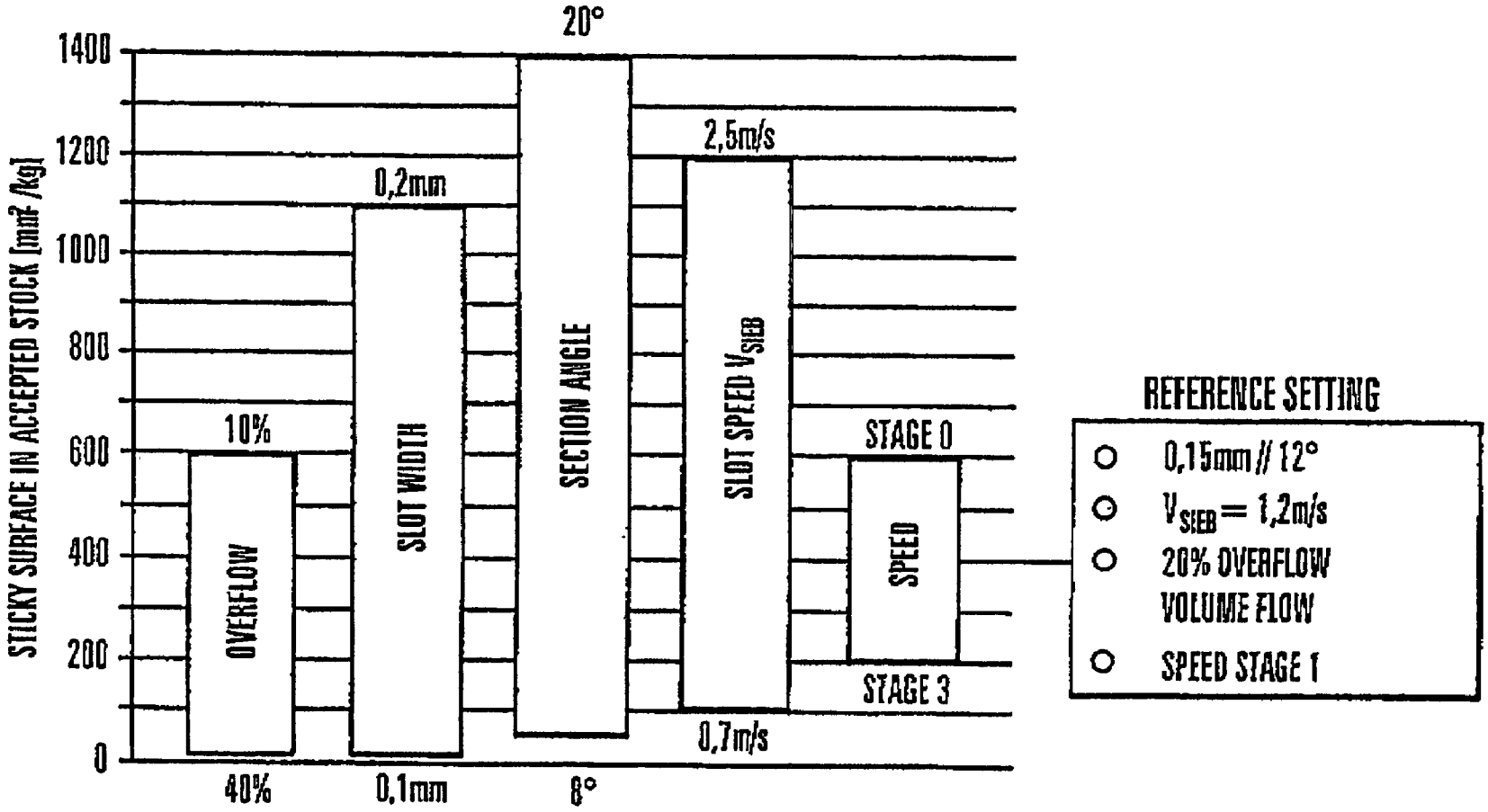
FIG. 1 a diagram to explain the influence of the machine parameters on the sorted results in accordance with an example.

FIG. 1 shows by way of an example how specific selectable parameters of sorters affect the purity of the fine fraction or of the accepted stock.

The sticky surface in the fine fraction (accepted stock) is drawn on the ordinate of this representation, with an increasing sticky surface in the accepted stock meaning a lower purity.

Different parameters are entered on the abscissa.

The parameter referring to the overflow relates to the volume of the reject which can be set in operation of the sorter, measured volumetrically here. The slot width refers to the screen basket of the sorter used. The section angle is to be understood as that angle at which the upper rim of a screen rod is inclined with respect to the periphery, with a large section angle corresponding to a relatively strong vorticity in the inflow region of the slit screen, which means a higher throughput, on the one hand, but a lower purity of the accepted stock, on the other hand.

The slot speed relates to the suspension on passing through the slot. It essentially results from the total slot area and from the volume flow pumped through the sorting machine.

The speed is the speed of the rotor of a sorter which is provided to keep the screen free and which can preferably be operated at different speeds.

A reference setting is set forth in the right hand part of FIG. 1 as an example.

Figure 2:
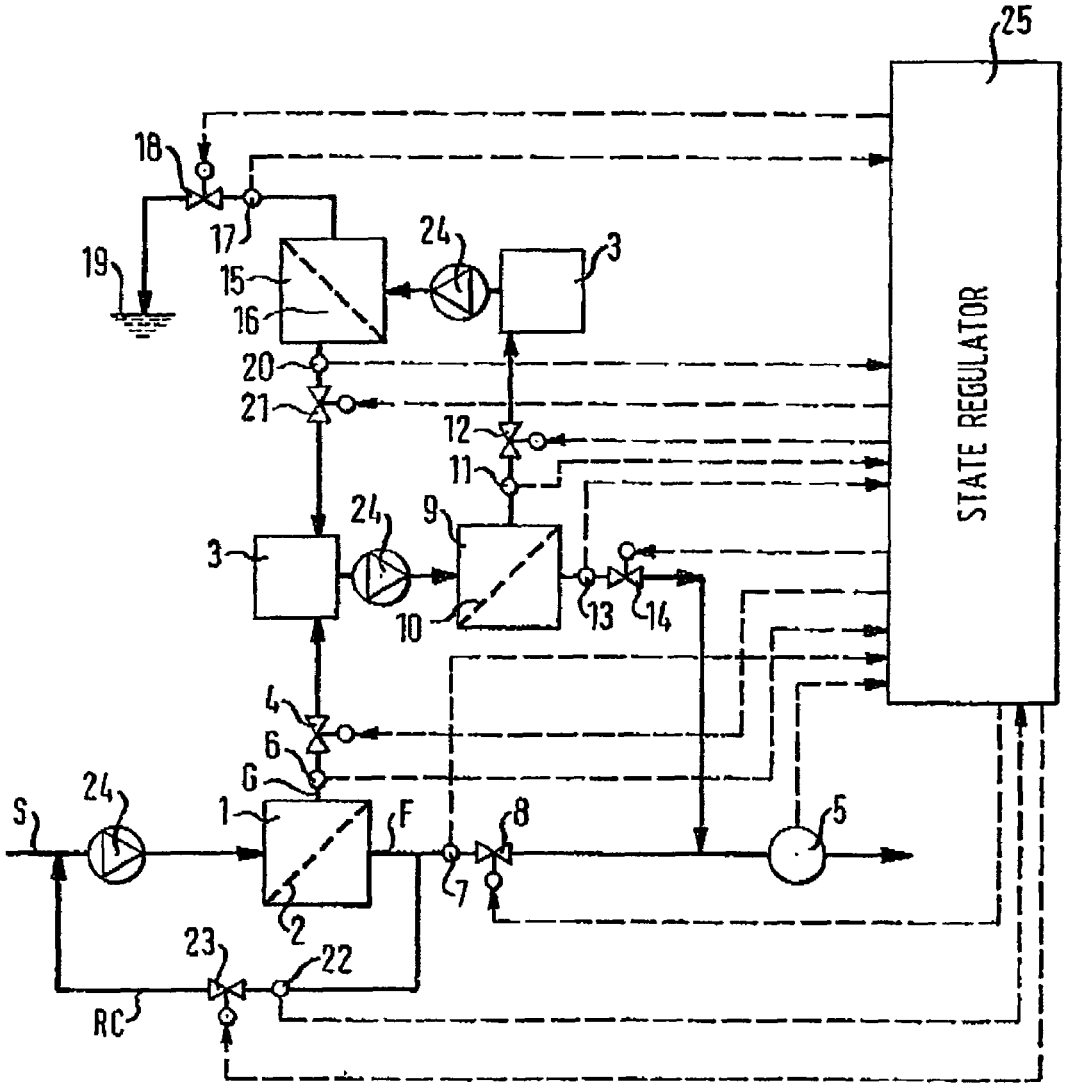
FIG. 2 a diagram to explain an example of a sorting system in accordance with the invention.

FIG. 2 shows a diagram of a three-stage sorting plant representing an example of the invention.

As can be seen with reference to FIG. 1, the parameters overflow volume and slot speed, which can be influenced in operation, have a substantial influence on the system efficiency. The same applies comparably to the fiber loss and to the concentration factor. Such relationships are decisive for enabling the sorting system to be modeled mathematically by a linear equation system and for enabling the respective plant to be run in the desired optimum operating state using such a model in a state regulator.

The sorting plant shown as an example in FIG. 2 is designed in three stages and is regulated in operation via a state regulator 25.

The plant includes a first sorter 1 in which a screen 2 is located. The screen contains a plurality of openings which are designed such that some of the inflowing fiber suspension S can pass through the openings as the fine fraction F, while a coarse fraction G is rejected.

The supply of the suspension 5 takes place via a pump 24. A throughflow sensor 7 and a setting valve 8 are arranged in the discharge line for the fine fraction F and a corresponding throughflow sensor 6 and a corresponding setting valve 4 are provided in the discharge line for the coarse fraction.

The throughflow sensors 6, 7 deliver their signals to the state regulator 25, while the setting valves 4, 8, receive their control signals or regulating signals from the state regulator 25.

The coarse fraction G of the first sorter 1 is supplied to a second sorter 9 with a screen 10 via a collecting unit 3 and a pump 24. A throughflow sensor 13 and a setting valve 14 are also arranged in the discharge line for the fine fraction and a throughflow sensor 11 and a setting valve 12 are also arranged in the discharge line for the coarse fraction with this sorter 9, with the sensors again delivering their signals to the state regulator 25 and the setting valves 12, 14, being controlled or regulated by the state regulator 25.

While the fine fraction of the second sorter 9 is supplied to the discharge line for the fine fraction F of the first sorter 1, the coarse fraction of the second sorter 9 reaches a third sorter 15 with a separating screen 16 via a collecting unit 3 and a pump 24.

It also applies to this third sorter 15 that a respective throughflow sensor 20 and 17 respectively and a setting valve 21 and 18 respectively are provided both in the discharge line for the fine fraction and in the discharge line for the coarse fraction, with the throughflow sensors again, in an analog manner to the preceding sorters, delivering their measured signals to the state regulator 25, while the setting valves 21 and 18 are controlled or regulated by this state regulator 25. The fine fraction of the third sorter 15 is supplied via the collecting unit 3 and the pump 24 to the second sorter 9 which likewise receives the coarse fraction of the first sorter via the collector unit 3.

A complete balancing of the mass flows in all sorters is made possible via the online throughflow measurements. The target parameters production and fiber loss are thus determined.

The target parameter efficiency or accepted stock quality can likewise be determined via an online quality sensor 5 whose output signals are supplied to the state regulator 25 for further processing. This is, however, not absolutely necessary. A sensible regulation or control is also possible in that the operator gives a qualitative pre-setting as to whether he would like to run a higher quality or a higher production.

A further development of the invention is characterized in that a return circuit RC is provided at least for the first sorter 1. This return circuit is branched off from the fine fraction F before the throughflow sensor 7 and is led to the inflow line for the suspension B, with the return expediently opening in front of the feed pump 24. A throughflow sensor 22 and a setting valve 23 are in turn arranged in the return circuit RC, with the sensor 22 delivering its signals to the state regulator 25 and the setting valve 23 being controlled or regulated by the state regulator 25. The return flow of the fine fraction can here be taken into the regulation concept as an additional operating parameter, with the advantage which can be achieved being that this additional operating parameter has a significant influence on the sorting efficiency, but only a low influence on the other operating parameters.

Figure 3:
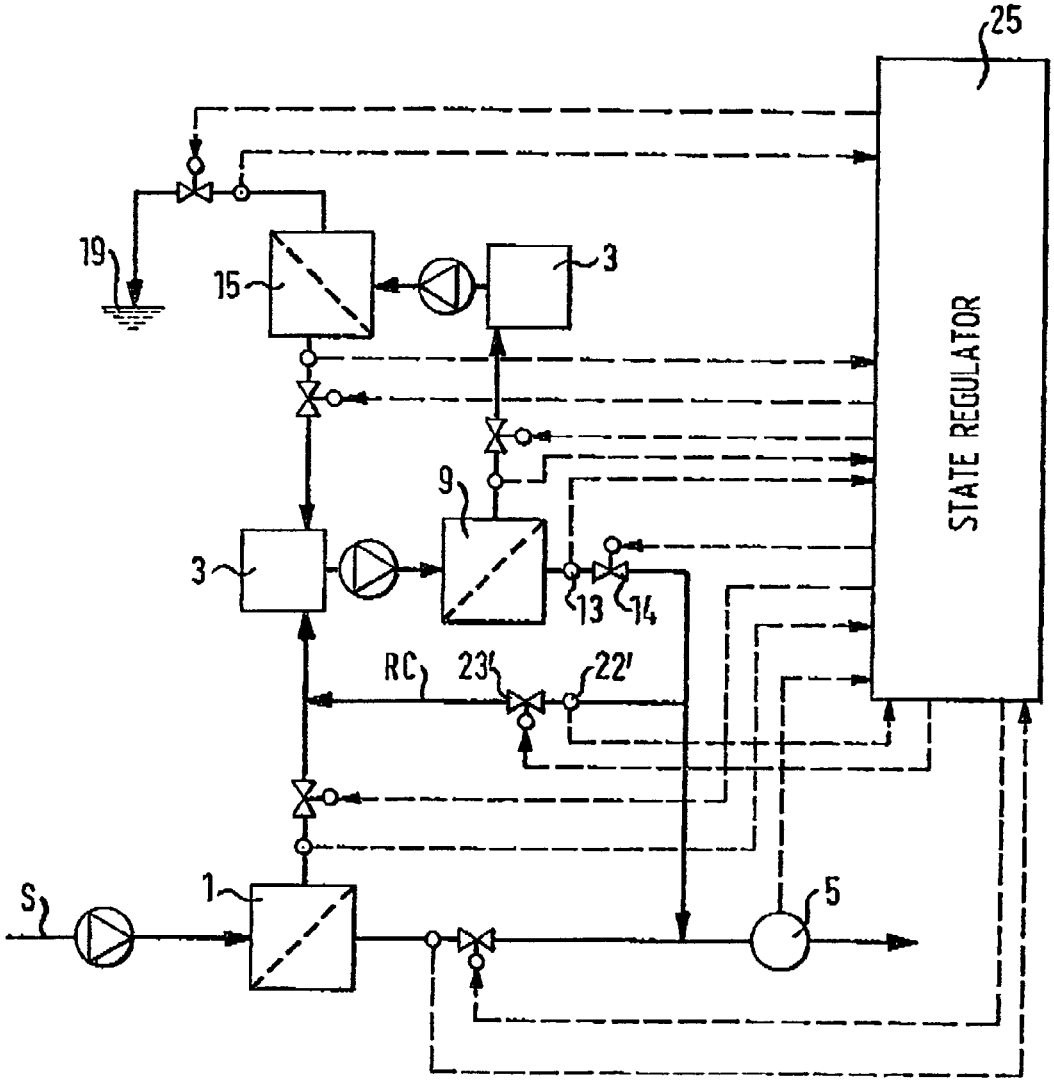
FIG. 3 a preferred variant of the example of FIG. 2.

FIG. 3 shows a particularly preferred variant of the invention which differs from the example of FIG. 2 in that the return circuit RC is not provided at the first sorter, but rather at the second sorter 9 of the plant shown. Analog to the embodiment of FIG. 2, a throughflow sensor 22' and a setting valve 23' are provided in this return RC, with the throughflow sensor 22' delivering its output signals to the state regulator 25, while the setting valve 23' receives its control signals or regulation signals from the state regulator 25. The use of a return circuit RC in a higher stage of the overall arrangement, as in the embodiment of FIG. 3 in connection with the stage 9, is particularly advantageous because the pollutant load is already larger in these stages and the return can thus develop the best possible efficacy.

It must be pointed that in connection with the examples of FIGS. 2 and 3 measurements on the output side and on the input side are generally provided, but that this does not mean that all mass flows must always be determined via measurements. It is equally possible for only some of the mass flows to be determined online via measured values and for the remaining mass flows to be determined by calculation. It is sufficient, for example with a sorter which is supplied or whose waste is disposed of via three connections, to determine two mass flows, because then a third mass flow can be calculated on the basis of work with an incompressible medium.

It is explicitly pointed out that the method in accordance with the invention can be realized with a larger and also with a smaller number of sorters in comparison with the examples of FIGS. 2 and 3.

REFERENCE NUMERAL LIST

1 first sorter
2 screen
3 collecting unit
4 setting valve, coarse fraction, first sorter
5 quality sensor
6 throughflow sensor, coarse fraction, first sorter
7 through flow sensor, fine fraction, first sorter
8 setting valve, fine fraction, first sorter
9 second sorter
10 screen
11 throughflow sensor, coarse fraction, second sorter
12 setting valve, coarse fraction, second sorter
13 throughflow sensor, fine fraction, section sorter
14 setting valve, fine fraction, second sorter
15 third sorter
16 screen

17 throughflow sensor, coarse fraction, third sorter
18 setting valve, coarse fraction, third sorter
19 waste
20 throughflow sensor, fine fraction, third sorter
21 setting valve, fine fraction, third sorter
22 through flow sensor return circuit
22 throughflow sensor (return circuit RC)
23 setting valve return circuit
23 setting valve (return circuit RC)
24 pump
25 state regulator (processor)

The invention claimed is:

1. A method of regulating multi-stage sorting systems in paper production, in which the fiber suspension (S) respectively supplied to a sorting stage is separated into at least two fractions, namely a fine fraction (F) and a coarse fraction (G), and at least one portion of a coarse fraction is again sorted and at least the thereby obtained fine fraction is returned to a sorting process, characterized in that, at each sorting stage (1, 9, 15) of a sorting system, mass flows at the input side and at the output side are determined by at least one of online measurement or by calculation and the values obtained are supplied to a processor (25) associated with the sorting system for mathematical modeling and state regulating of the sorting system;

in that at each sorting stage (1, 9, 15) a setting valve (4, 8, 12, 14, 18, 21) is arranged in at least one of a discharge line for the fine fraction and a discharge line for the coarse fraction, said setting valves (4, 8, 12, 14, 18, 21) being connected to said processor;

and in that said processor influences output side mass flows of the sorting stages (1, 9, 15) by controlling or regulating said setting valves (4, 8, 12, 14, 18, 21) and/or selectable machine parameters including at least one of slot width, slot speed, rotor speed and section angle of the sorting stages in dependence on pre-settable target parameters including at least one of production, efficiency, and fiber loss.

2. The method in accordance with claim 1, characterized in that at least some of the mass flows are determined online via at least one of throughflow measurements or consistency measurements.

3. The method in accordance with claim 1, characterized in that the mathematical modeling of the sorting system is carried out via a system of linear equations which describe the dependence of the target parameters on operating parameters.

4. The method in accordance with claim 3, characterized in that the system of linear equations is solved in the processor by means of real time algorithms.

5. The method in accordance with claim 3, characterized in that modified machine configurations are taken into account by matching constants of the system of linear equations.

6. The method in accordance with claim 5, wherein the modified machine configurations are wear or screen basket replacement.

7. The method in accordance with claim 1, characterized in that operating limits including at least one of minimum permitted throughput, minimum reject amount are pre-set via the mathematical modeling of the sorting system.

8. The method in accordance with claim 1, characterized in that all fine fractions are guided in a forward manner in the sorting system.

9. The method in accordance with claim 1, characterized in that a pre-settable portion of the fine fraction (F) of at least the first sorter (1) is led back to the input of this sorter (1).

10. The method in accordance with claim 9, characterized in that the portion of the fine fraction (F) led back is controlled or regulated via a state regulator (25).

11. The method in accordance with claim 1, characterized in that a quality sensor (5) detecting the discharge fine fraction (F) of the sorting system delivers an input signal for a state regulator (25).

12. The method in accordance with claim 11, characterized in that the signal supplied from the quality sensor (5) to the state regulator (25) influences at least an amount of the fine fraction led back at a first sorter (1).

13. The method in accordance with claim 1, characterized in that the respective target parameters are qualitatively pre-set individually or in selectable combinations via a state regulator (25).

* * * * *